US010535224B2

(12) United States Patent
De Knijff

(10) Patent No.: US 10,535,224 B2
(45) Date of Patent: Jan. 14, 2020

(54) GRAPHICAL REPRESENTATION OF WAGERING SELECTIONS

(71) Applicant: Metric Gaming LLC, Las Vegas, NV (US)

(72) Inventor: Martin De Knijff, Las Vegas, NV (US)

(73) Assignee: Metric Gaming LLC, Las Vegas, NV (US)

( * ) Notice: Subject to any disclaimer, the term of this patent is extended or adjusted under 35 U.S.C. 154(b) by 105 days.

(21) Appl. No.: 15/819,835

(22) Filed: Nov. 21, 2017

(65) Prior Publication Data

US 2018/0144582 A1 May 24, 2018

Related U.S. Application Data

(60) Provisional application No. 62/425,693, filed on Nov. 23, 2016.

(51) Int. Cl.
*G07F 17/32* (2006.01)
*G06Q 50/34* (2012.01)

(52) U.S. Cl.
CPC ..... *G07F 17/3244* (2013.01); *G07F 17/3211* (2013.01); *G07F 17/3288* (2013.01); *G06Q 50/34* (2013.01)

(58) Field of Classification Search
CPC ..... G07F 17/3244; G07F 17/3211; G07F 17/3288; G07F 17/32; G07F 17/323; G06Q 50/34
See application file for complete search history.

(56) References Cited

U.S. PATENT DOCUMENTS

2006/0151943 A1* 7/2006 Bozeman ..... G07F 17/329 273/138.1
2012/0214575 A1* 8/2012 Amaitis ..... G06Q 50/34 463/25
2014/0066180 A1* 3/2014 Marantelli ..... G07F 17/3288 463/25
2014/0087824 A1* 3/2014 Caputo ..... G07F 17/326 463/20
2015/0262456 A1* 9/2015 Shore ..... G07F 17/3288 463/25
2017/0018138 A1* 1/2017 McBurnie ..... G07F 17/323

* cited by examiner

*Primary Examiner* — David Duffy
*Assistant Examiner* — Ankit B Doshi
(74) *Attorney, Agent, or Firm* — Mintz Levin Cohn Ferris Glovsky and Popeo, P.C.

(57) ABSTRACT

A system, a method, and a computer program product for generating graphical representations of wagering selections. A plurality of potential scoring occurrences in an event is received. A graphical representation of each of the potential scoring occurrences on a user interface is generated based on the received first data. A plurality of graphical positions corresponding to a portion of the plurality of potential scoring occurrences is selected to generate at least one graphical pathway identifying at least one wagering selection in the plurality of wagering selections for the event. During a progression of the event, a determination is made whether at least one identified wagering selection in the plurality of wagering selections for the event did not generate a winning wager, where such selection is removed from the user interface. At the conclusion of the event, a winning amount based on the plurality of selected graphical positions is displayed.

18 Claims, 13 Drawing Sheets

900

90

GRAPHICAL REPRESENTATION OF WAGERING SELECTIONS

CROSS-REFERENCE TO RELATED APPLICATIONS

The present application claims priority to U.S. Provisional Patent Appl. No. 62/425,693 to de Knijff, filed Nov. 23, 2016, and entitled "Maze Betting Platform" and incorporates its disclosure herein by reference in its entirety.

TECHNICAL FIELD

In some implementations, the subject matter described herein generally relates to a wagering platform on an event, such as a sporting and/or entertainment event.

BACKGROUND

Traditional wagering platforms allow participants to wager only on the final outcome of a sporting event or other aspect of the final result (e.g., winner/loser and over/under). Thus, there is a need for a computing platform that can allow users to place wagers not only on the final outcome and/or final result of an event or an occurrence, but also place wagers during progression of the event/occurrence as well as on various stages and discrete in-game aspects of the event/occurrence.

SUMMARY

In some implementations, the current subject matter relates to a computer implemented method for generating graphical representation of wagering selections. The method can include receiving a first data identifying a plurality of potential scoring occurrences in an event, and generating, based on the received first data, a graphical representation of each of the potential scoring occurrences on a user interface. The generation of graphical representations can include arranging, using an identifier corresponding to each potential scoring occurrence, a graphical position of each potential scoring occurrence in the plurality of scoring occurrences on the user interface to display a graphical maze. The method can also include selecting a plurality of graphical positions corresponding to a portion of the plurality of potential scoring occurrences to generate at least one graphical pathway identifying at least one wagering selection in the plurality of wagering selections for the event. The plurality of wagering selections can correspond to the plurality of selected graphical positions. Further, the method can include determining, during a progression of the event in real-time, whether at least one identified wagering selection in the plurality of wagering selections for the event did not generate a winning wager, removing from the user interface determined wagering selection, and displaying, at the conclusion of the event, on the user interface a winning amount based on the plurality of selected graphical positions. The receiving, the generating, the selecting, the determining, and the displaying operations can be performed using at least one processor of at least one computing system.

In some implementations, the current subject matter can include one or more of the following optional features. In some implementations, the method can also include determining, during the progression of the event, whether at least one identified wagering selection in the plurality of wagering selections for the event generated a winning wager, and displaying, at the conclusion of the event, a winning amount corresponding to the winning wager on the user interface.

In some implementations, the method can include removing, during the progression of the event, from the user interface at least one identified wagering selection in the plurality of wagering selections that will not be generating a winning wager. The removed wagering selection can correspond to at least one selected graphical position associated with a potential scoring occurrence that did not match an actual scoring occurrence during progression of the event.

In some implementations, the method can include displaying, on the user interface, a counter having a counter value corresponding to a number of identified wagering selections. The counter value can be decreased based on a determination that at least one wagering selection is removed from the user interface.

In some implementations, the current subject matter relates to an interactive wagering platform, including a method for wagering on an exact sequence of occurrences in a sporting event, e.g., the precise scoring progression of a game in tennis. For example, a bettor can place certain wagers on a particular sequence of scores that can potentially occur during a game. The method can include providing a user-interface that employs a maze-like visualization and displaying a plurality of graphical objects forming a series of graphical pathways, representing possible sequences of occurrences during the game (e.g., scores or score changes during the game). The method can further include selecting a graphical pathway through a predetermined set of objects, wherein the selected pathway can represent a wagered scoring progression. If the wagered scoring progression matches an actual scoring progression of the game, the bettor can be credited with a payout equal to a factor (e.g., a multiple) of the bettor's original stake. In some implementations, the payout can be determined in part by the likelihood of the scoring progression predicted.

Non-transitory computer program products (i.e., physically embodied computer program products) are also described that store instructions, which when executed one or more data processors of one or more computing systems, causes at least one data processor to perform operations herein. Similarly, computer systems are also described that may include one or more data processors and memory coupled to the one or more data processors. The memory may temporarily or permanently store instructions that cause at least one processor to perform one or more of the operations described herein. In addition, methods can be implemented by one or more data processors either within a single computing system or distributed among two or more computing systems. Such computing systems can be connected and can exchange data and/or commands or other instructions or the like via one or more connections, including but not limited to a connection over a network (e.g. the Internet, a wireless wide area network, a local area network, a wide area network, a wired network, or the like), via a direct connection between one or more of the multiple computing systems, etc.

The subject matter described herein provides many advantages. For example, the current subject matter provides an interactive wagering platform that can enhance participant/spectator experience. The current subject matter can also provide a gaming experience with financial or other rewards to winning bettors.

The details of one or more variations of the subject matter described herein are set forth in the accompanying drawings and the description below. Other features and advantages of the subject matter described herein will be apparent from the description and drawings, and from the claims.

BRIEF DESCRIPTION OF DRAWINGS

The accompanying drawings, which are incorporated in and constitute a part of this specification, show certain aspects of the subject matter disclosed herein and, together with the description, help explain some of the principles associated with the disclosed implementations. In the drawings.

DETAILED DESCRIPTION

Figure 1:
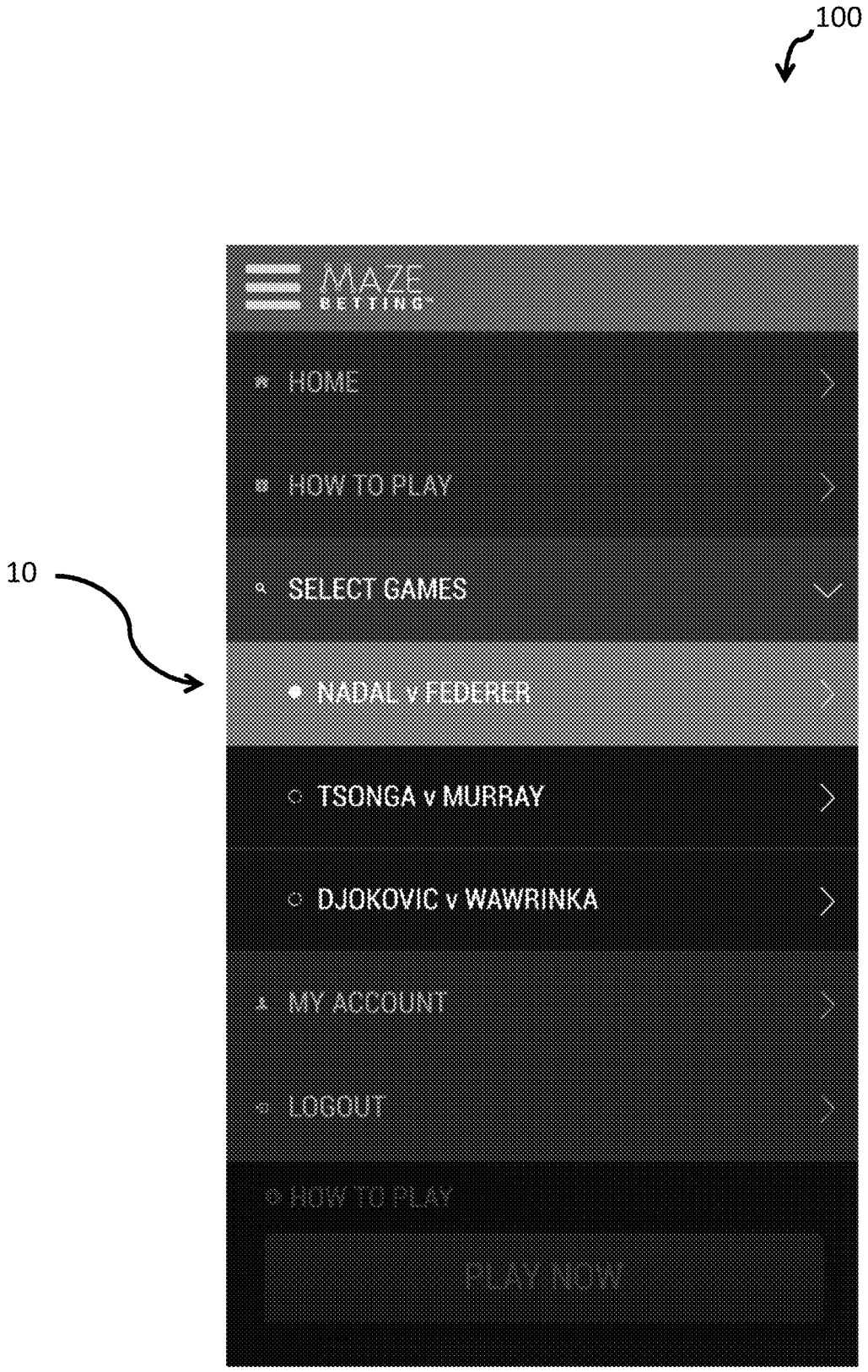
FIGS. 1-10 are screenshots illustrating exemplary implementations of a maze wagering platform, according to some implementations of the current subject matter.

In some implementations, the current subject matter is directed to a wagering platform that can enable one or more bettors (e.g., users (e.g., humans, software applications, objects, etc.) of the platform) to wager on an event, such as a sporting or entertainment event, to facilitate, for example, additional enjoyment and participation during the event.

In some implementations, the current subject matter can enable a bettor to wager on a particular scoring progression of a sporting event such as a tennis game, where a correct prediction can entitle the bettor to a payout equal to a multiple of the original wagered stake. In some implementations, the bettor can wager on a portion of a scoring progression or a complete scoring progression. For example, for tennis, a bettor can wager on the progression of a game, a set, a match, as well as combinations thereof.

Progressions/Pathways:

As an illustrating (non-limiting) example, the current subject matter can be implemented for a tennis game, where the bettor can wager on a selected scoring progression of the game (who wins each point of the tennis game).

The current subject matter can also be implemented for other sporting events, such as (for example), American football, baseball and golf. For example, in some variations, the current subject matter can allow bettors to wager on the exact progression of a golfer's strokes on a hole, the exact progression of pitches during an at-bat, or the exact progression of plays in a drive in American football. These examples are provided for illustration purposes. Other variations may include, for example, additional defined progressions, other defined progressions; and/or various combinations.

Selection Process:

In some implementations, the current subject matter can provide each bettor with one or more options for how to select a progression after designating the relevant sport/event in which the progression will occur:

(1) Manual selection: The platform can be configured to allow the bettor to select manually from an array of objects such as dots in a user interface representing all possible combinations of progressions, via an input such as a mouse on a laptop/desktop or a touchscreen on a smartphone or tablet.

(2) Automatic "Quick Pick": The platform can be configured to assign one or more graphical "pathways" representing various progressions for the bettor. In some implementations, the bettor can select a total number of pathways he or she would like to wager, and the platform then generates that specified number of pathways. In some implementations, the platform allows the bettor to modify one or more of the generated pathways, including, for example, adding pathways, removing pathways, or altering pathways. In some implementations, the one or more pathways can be generated randomly. In some implementations, the one or more pathways can be generated based at least in part on one or more user preferences and/or prior selections.

In some implementations, regardless of the selection method, the platform can provide the bettor with a chance to review and confirm all pathways before committing to any wager.

Scoring Visualization:

After the bettor has confirmed his or her chosen pathways, in some implementations, the platform can provide real-time updates as the corresponding real-life event (e.g., a tennis game) progresses. In some implementations, the platform can provide a visualization of the correct pathways out of the "maze" as each step in the progression sequence is determined. The visualization provided by the platform allows the bettor to follow along with a visual aid to track the success of each wagered pathway. Once a particular progression is complete, the platform can, in some implementations, generate and send the bettor a message notifying the bettor whether he or she has won, along with the total amount of any winnings.

References will now be made to FIGS. 1-10, which illustrate implementations of the current subject matter. As can be understood, the exemplary implementations shown in FIGS. 1-10 are provided for illustrative purposes only and are not intended to limit the subject matter of the present application.

FIG. 1 shows a graphic display of a selection page 100 for a wagering platform, according to some implementations of the current subject matter. For example, the selection page 100 can be generated using the wagering platform shown in FIG. 11 in accordance with a process shown in FIG. 13. The graphic display can be generated using any hardware, software, and/or any combination thereof. The display can be generated using a wireless telephone, a smartphone, a phablet, a tablet, a personal computer, a laptop computer, smartwatch, a personal digital assistant, and/or any other device and/or any combination thereof. In some implementations, the device can be communicatively coupled to one or more servers configured to provide event information, event progression information, wagering information, outcome information, etc. and/or any combination thereof to the device displaying the selection page 100. The servers can be communicatively coupled using one or more wired, wireless, and/or any other type of communications network. The device displaying page 100 can be configured to receive and/or transmit information to a network of servers (e.g., one server transmitting/receiving information relating to the event, another server transmitting/receiving information relating to wagering data, etc.) and/or databases containing information relating to the event and/or wagering data.

In some implementations, the graphic display can provide an example of a sport/event selection page where a bettor can select among various sporting events (as shown in FIG.

1, tennis matches, etc.). As shown, the bettor has chosen a tennis match 10 between professional tennis players Rafael Nadal and Roger Federer.

Figure 2:
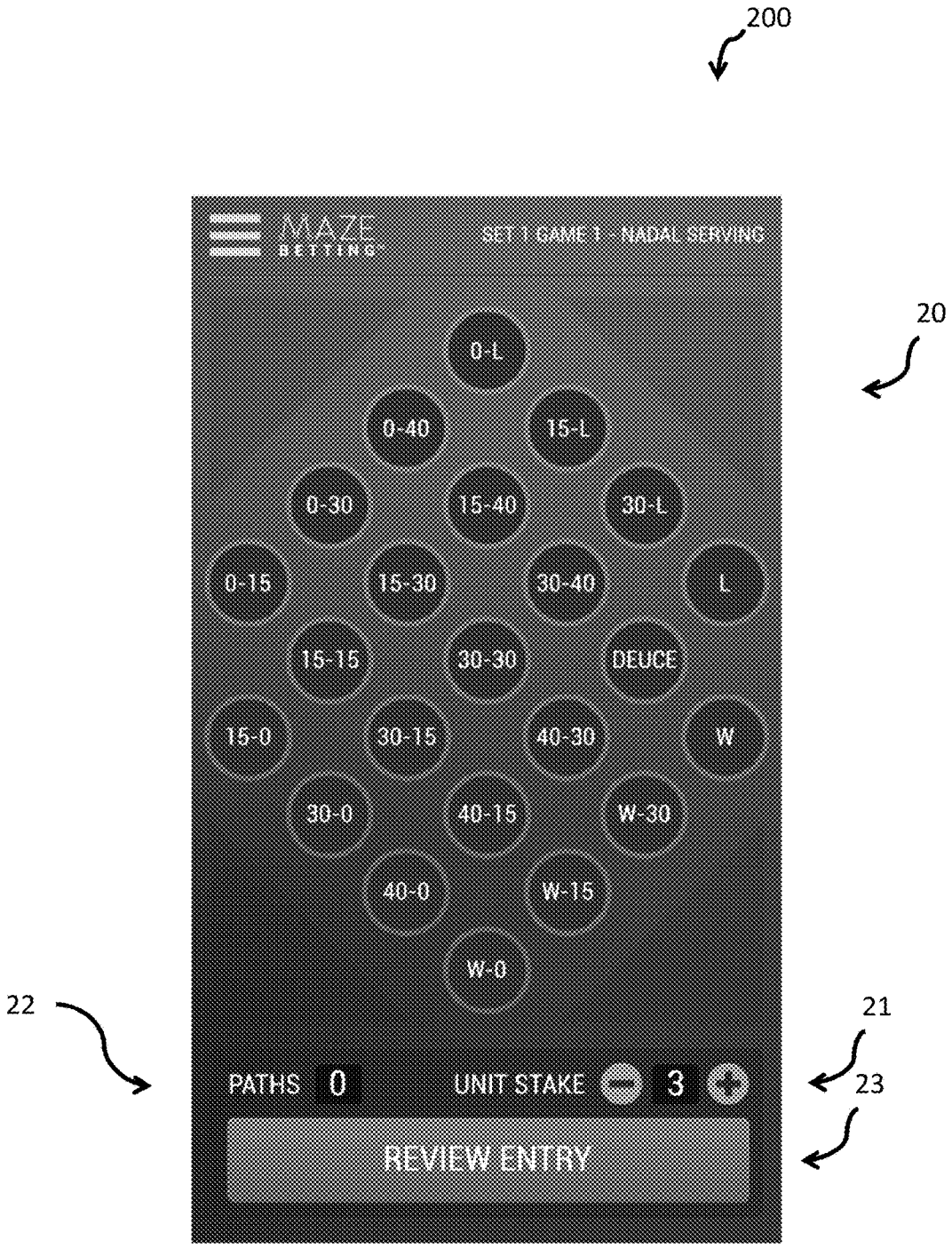

In FIG. 2, the platform provides a pathway selection page 200 on which the platform provides the user with a maze-like user interface 20 where the bettor can now select his or her pathways. The bettor is further presented with the ability to adjust his or her stake per pathway 21, a counter 22 that keeps track of how many pathways the bettor has selected, and a button 23 to allow the bettor to review his or her entry.

Figure 3:
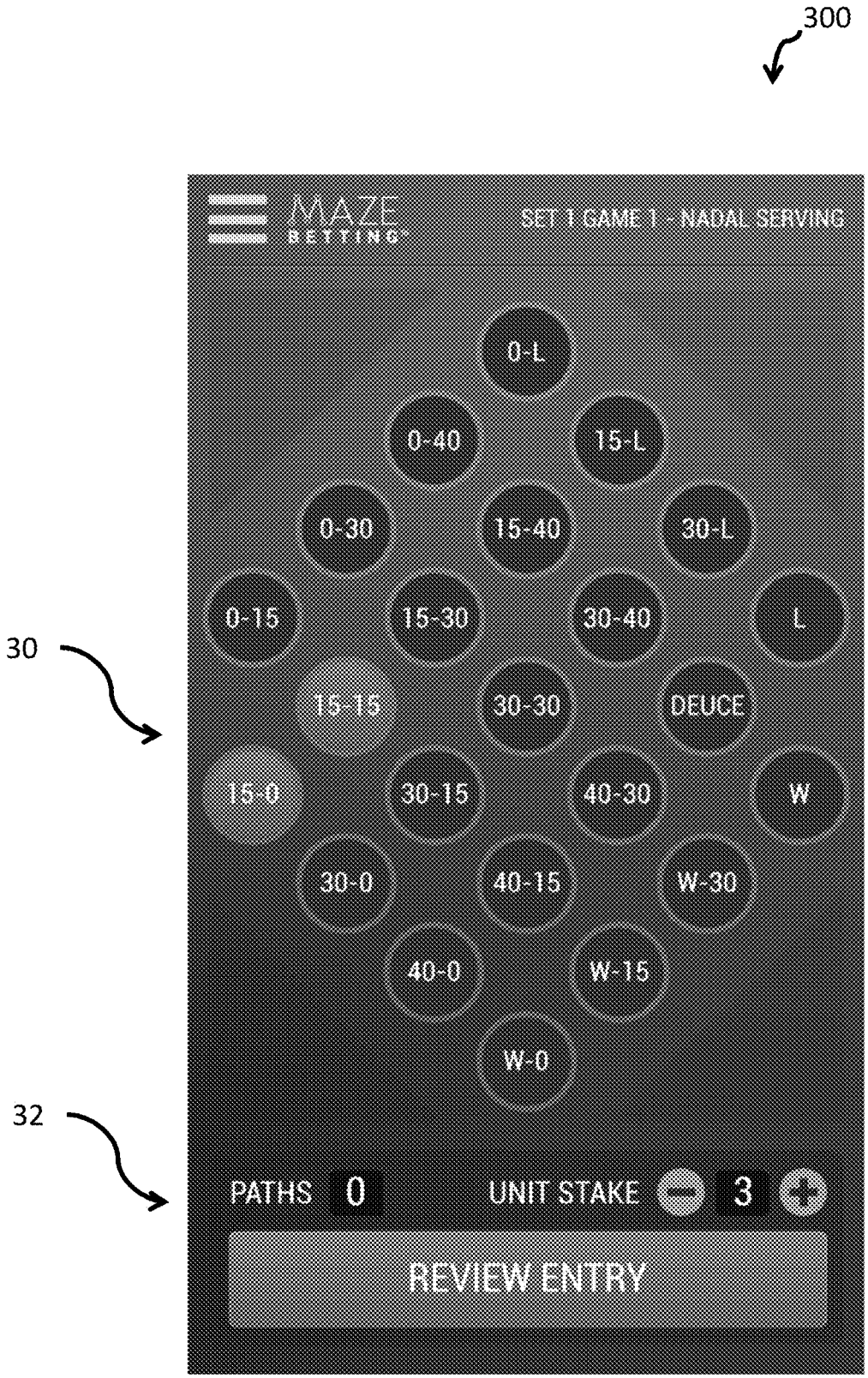

In the pathway selection page 300 shown in FIG. 3, the bettor has started to select a pathway (or multiple pathways) by selecting two points 15-0 and 15-15, as indicated by the platform highlighting those two points 30. Because no complete pathway has yet been selected, however, the "Paths" counter 32 in the lower left-hand corner still reads "0".

Figure 4:
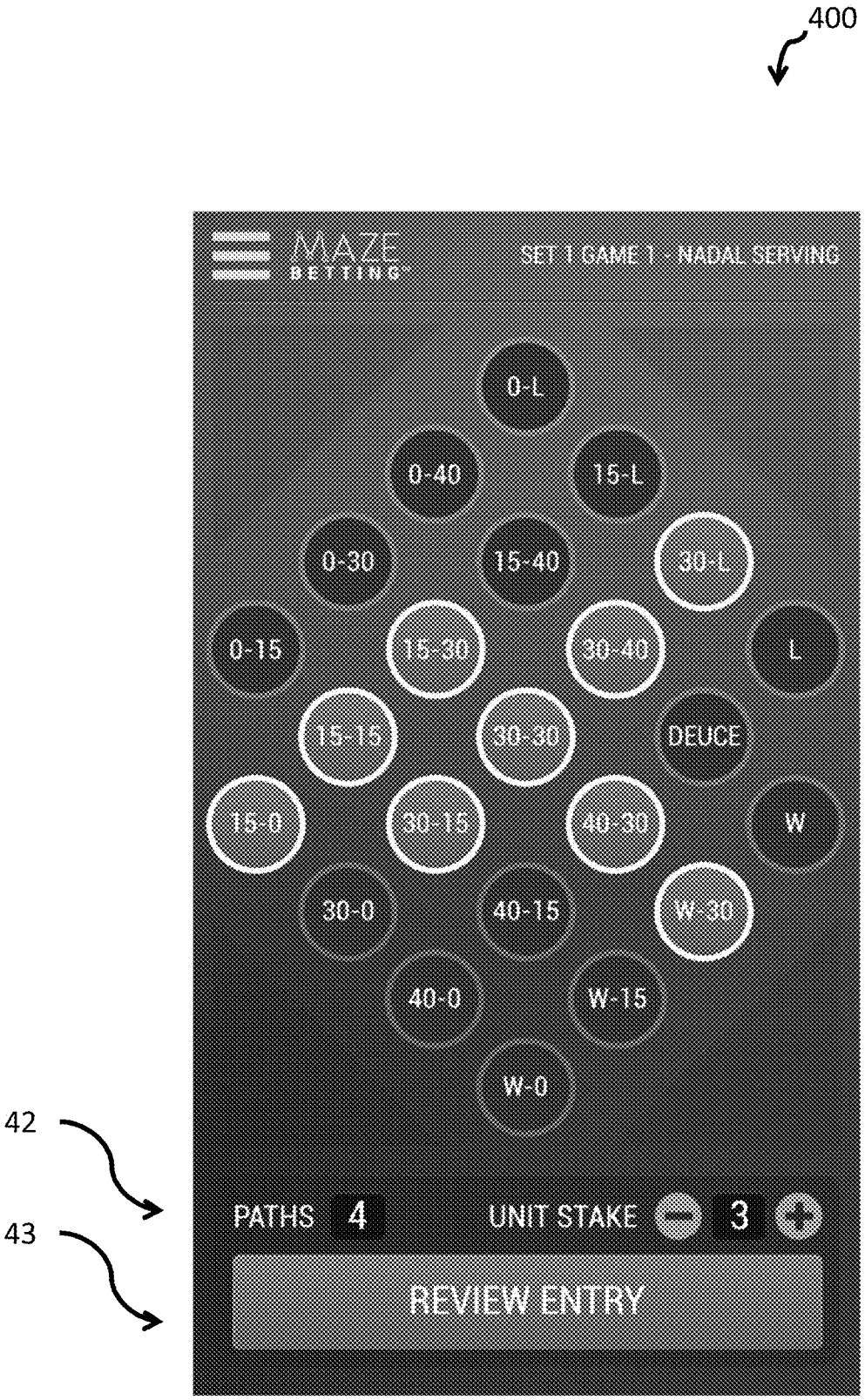

In the pathway selection page 400 in FIG. 4, the bettor has now completed his or her pathways, as indicated by the highlighted points selected, which extend all the way to the outer edge of the "maze." Here, the bettor has selected a total of four pathways out of the maze, as confirmed by the "Paths" counter 42 in the lower left-hand corner.

Figure 5:
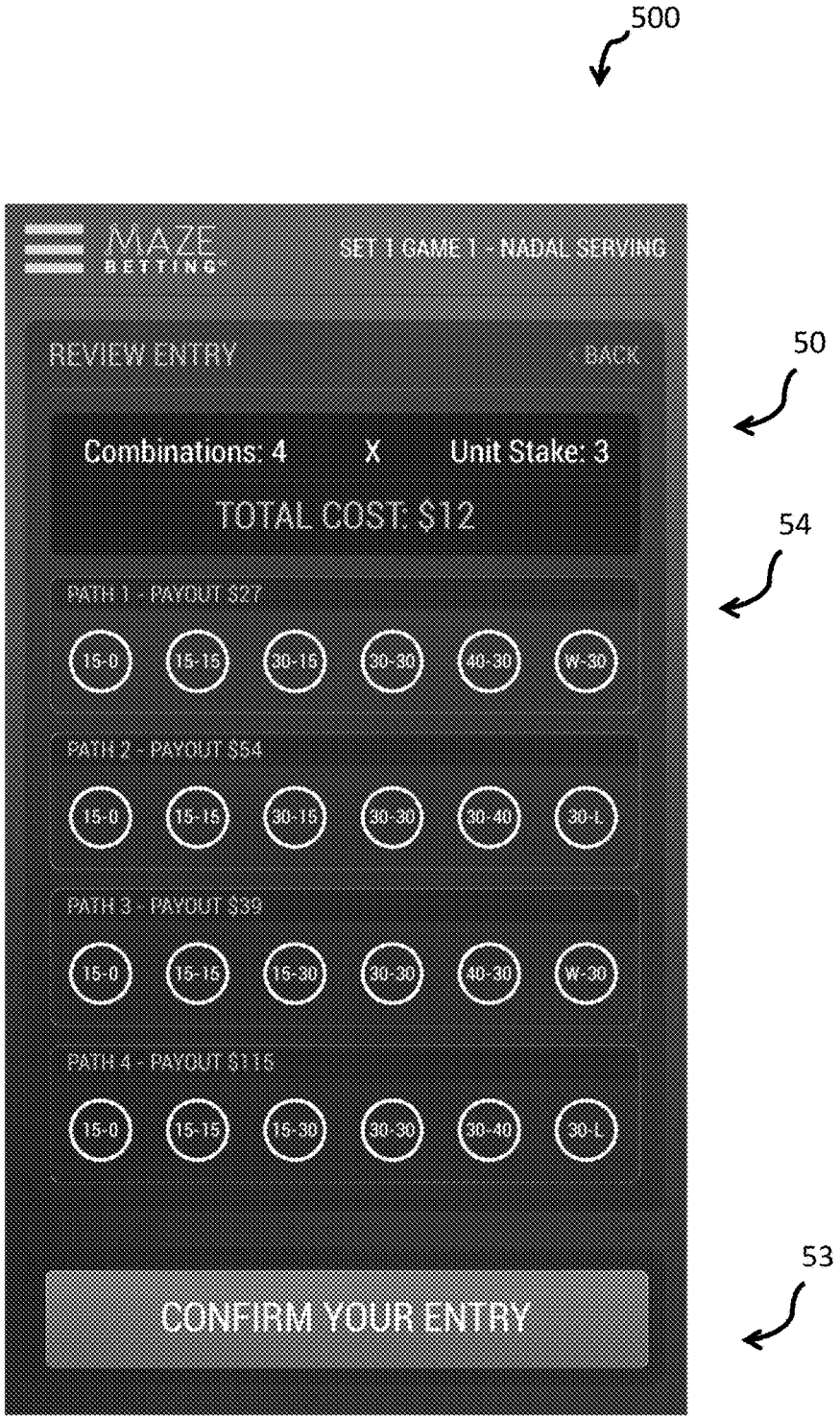

In the pathway confirmation page 500 shown in FIG. 5, the bettor has selected the "Review Entry" button 43 from pathway selection page 400 (FIG. 4), and is now presented with each of the four pathways 54 he or she has selected, along with the total proposed wager amount (based on the unit stake designated in the previous screen) 50 and a confirmation button 53 that allows the bettor to confirm his or her entry.

Figure 6:
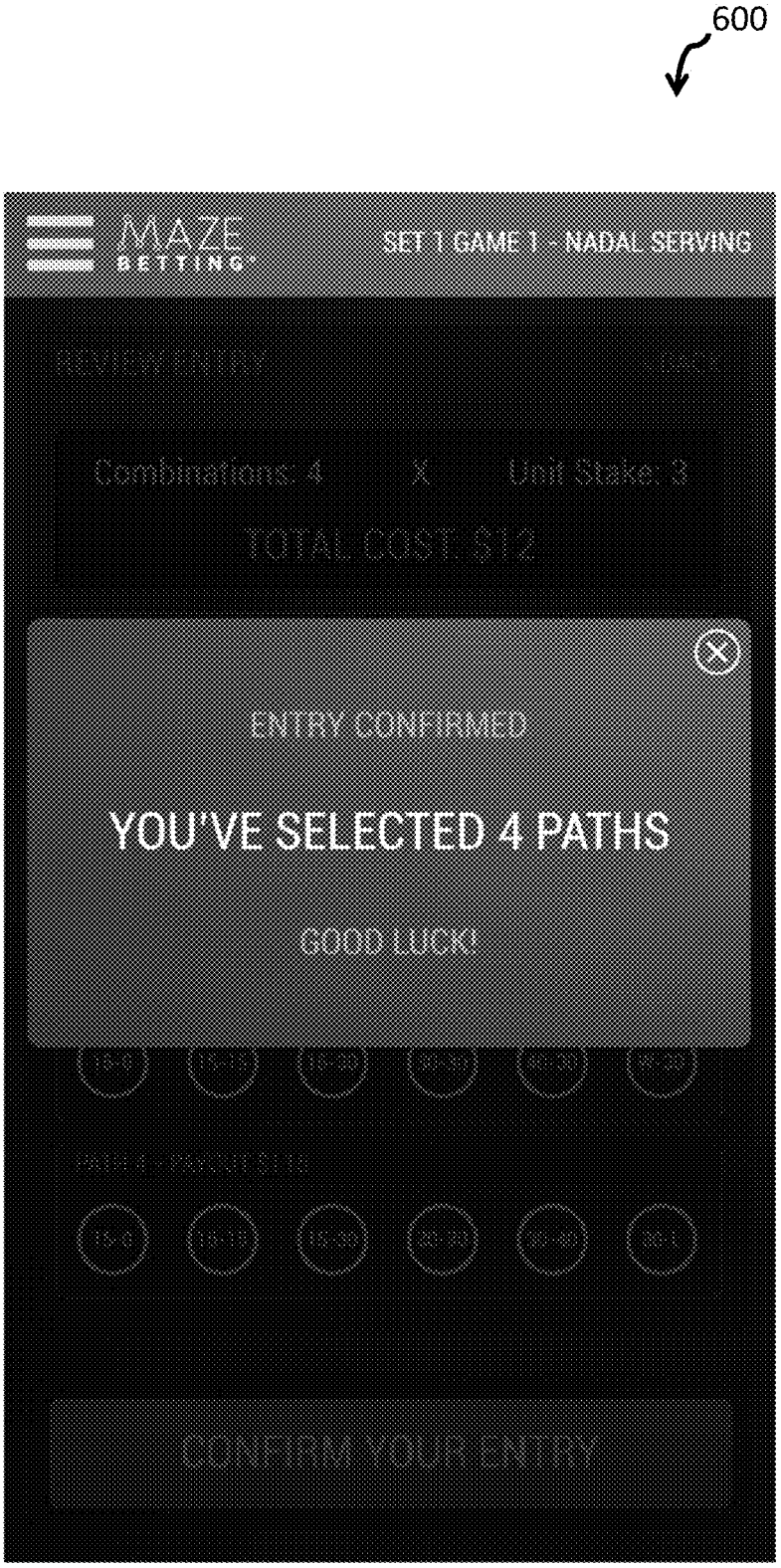

FIG. 6 shows an entry confirmation page 600, which can be displayed once the bettor has selected the confirmation button 53 from the pathway confirmation page 500 (FIG. 5), and is presented with a confirmation message. In some implementations, the platform can store the wager data relating to the four pathways 54 in a wager database.

Figure 7:
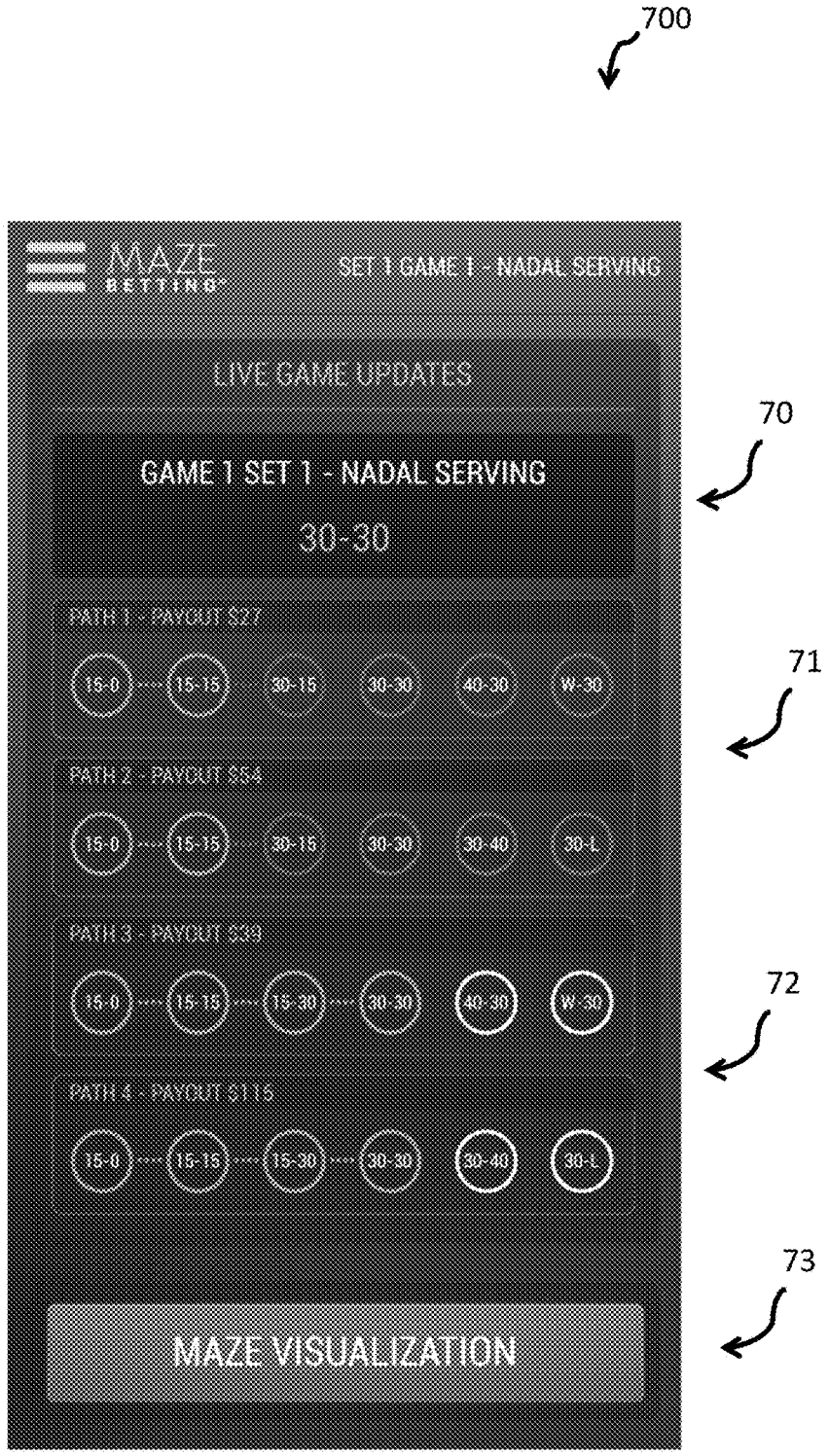

In FIG. 7, the game that the bettor has just wagered on has now begun and the bettor is presented with live game updates page 700. This page can display the game score in real time 70, as well as the progression of each of the pathways selected. Here, the game score was 15-30 before it became 30-30, thus disqualifying the first two pathways 71 but keeping the remaining pathways 72 in play. The platform can also present the bettor with a maze visualization button 73.

Figure 8:
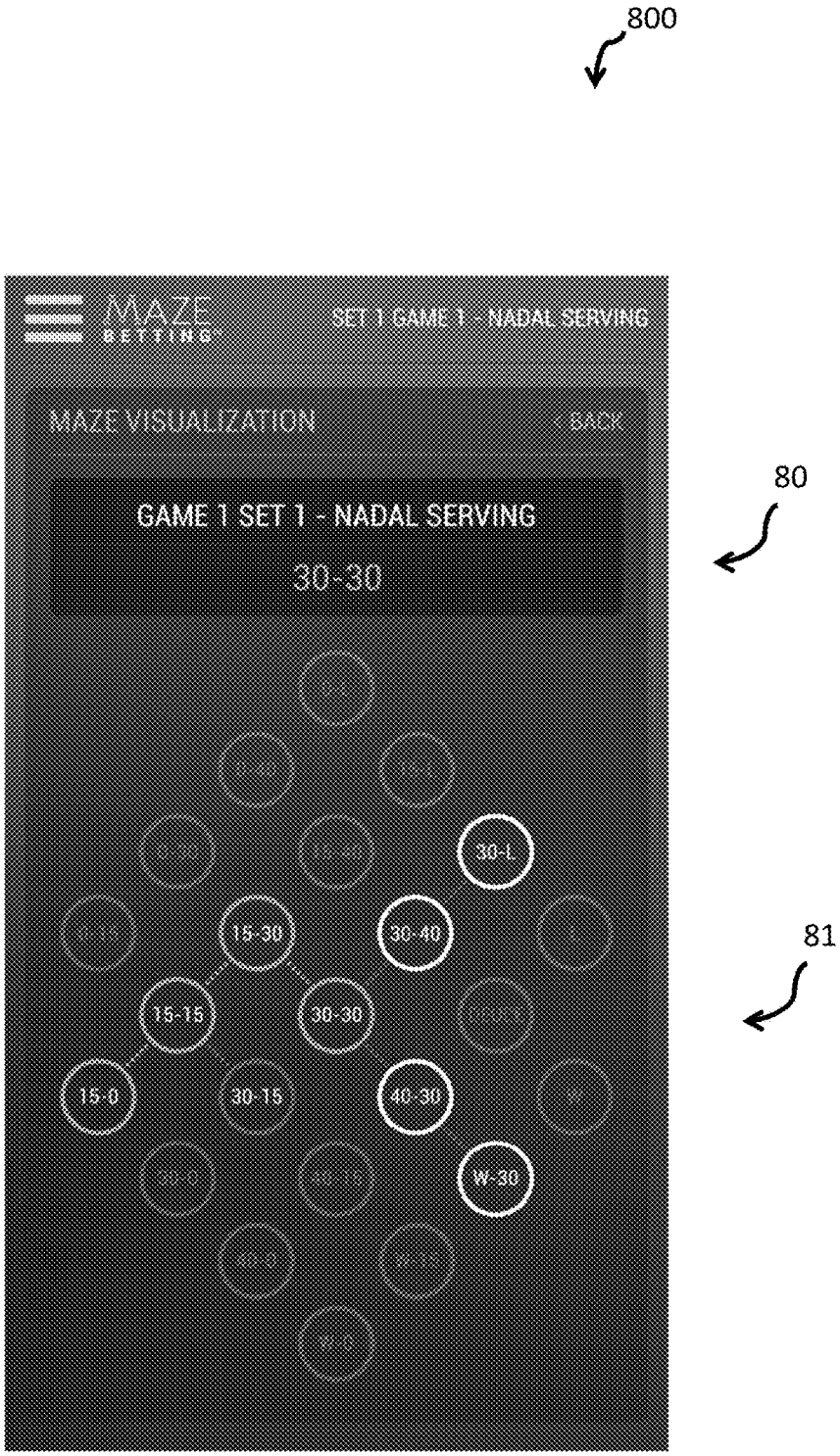

In FIG. 8, the bettor has selected the maze visualization button 73 from live game updates page 700 (FIG. 7), and thus the platform generates a maze visualization page 800 on which the bettor is provided with a visual aid to track his or her selected pathways. Here, the bettor is presented with the current game score 80 and the game's scoring progression so far (by highlighting the dots representing the correct score after each point of the game), indicating which pathways have been disqualified (as can be shown with a red highlight) and which ones are still active (as can be shown with a green highlight) 81. In some implementations, different colors and/or visual representations can be utilized by the platform to provide a visual representation of the game in play.

Figure 9:
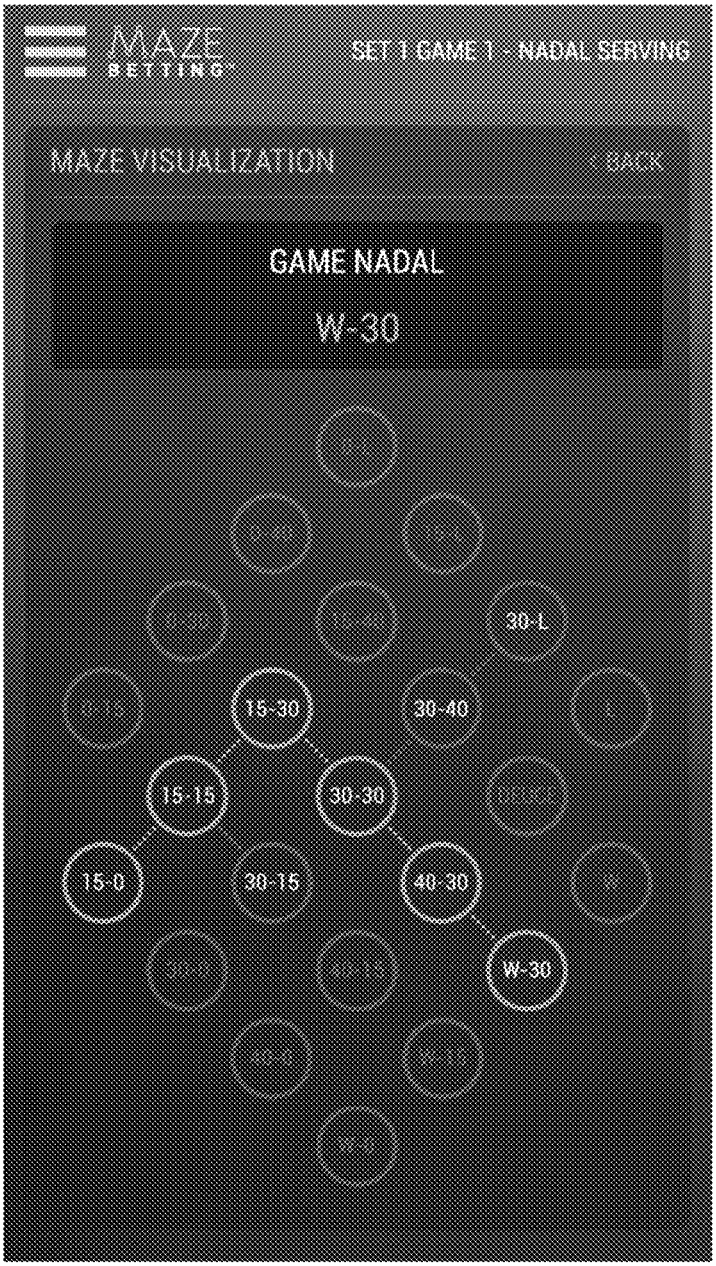

As shown in FIG. 9, the game has now ended and the maze visualization page 900 reflects the final scoring progression. The entire correct pathway has accordingly been conclusively determined, as can be shown with each point of the correct pathways being highlighted, for example, in green 90.

Figure 10:
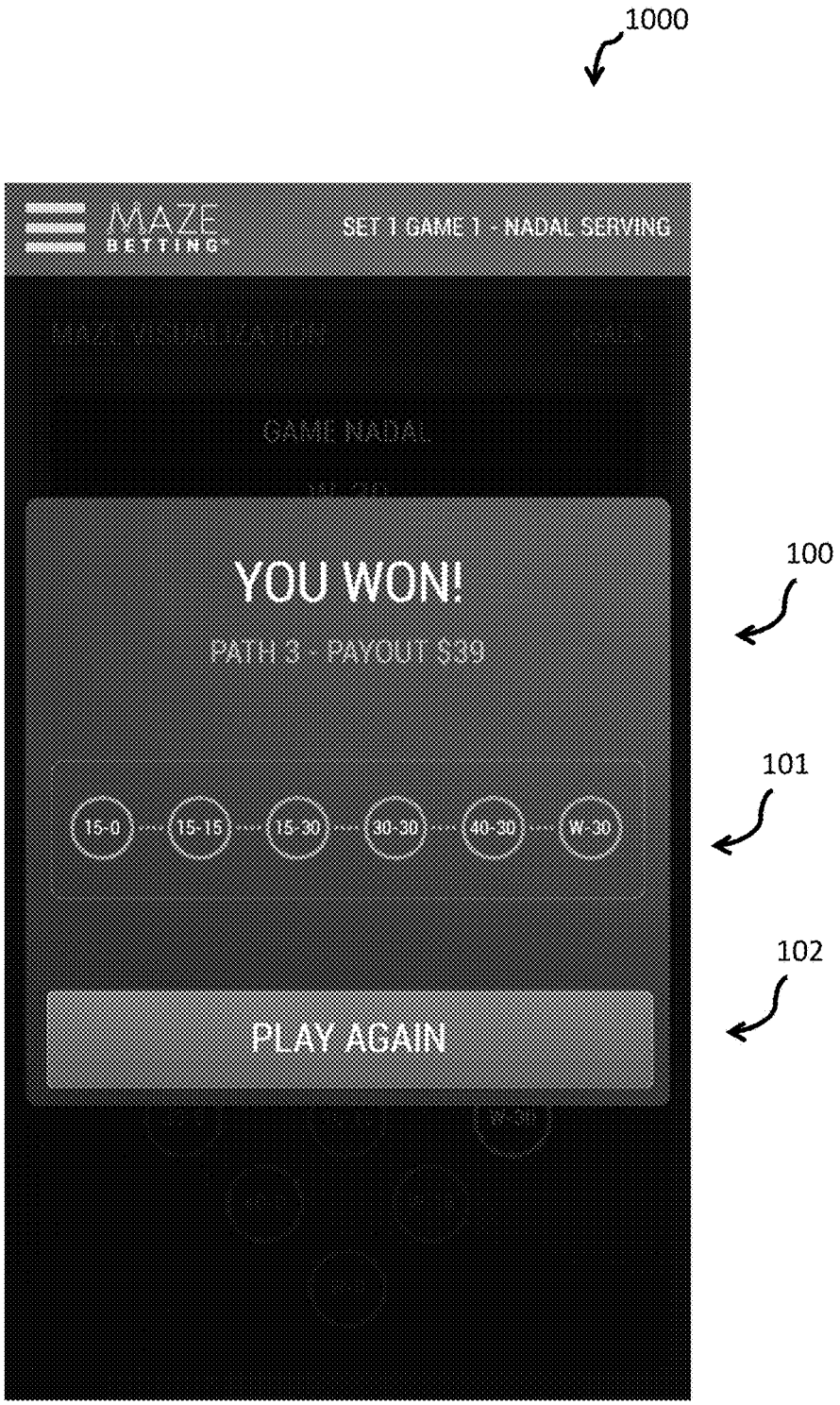

FIG. 10 shows a message 1000 that the platform has generated to indicate to the bettor that he or she has selected a winning pathway. The platform notifies the bettor how much he or she has won 100 and displays the winning selection 101. The bettor is also presented with a play again button, which can start the selection process over for the next or a different game in the match.

Figure 11:
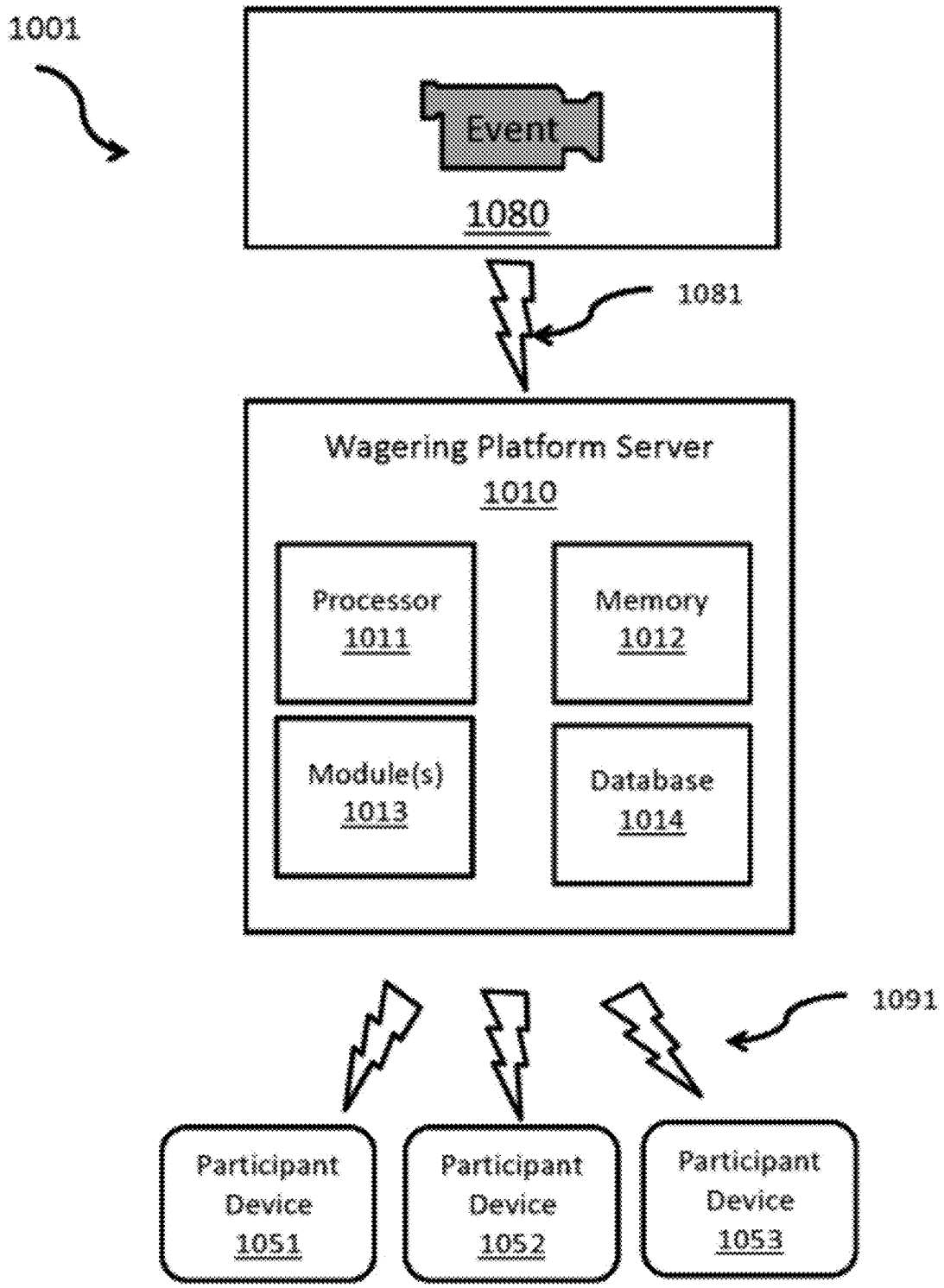
FIG. 11 illustrates an exemplary maze wagering platform system, according to some implementations of the current subject matter.

FIG. 11 shows an example of a computer-implemented wagering platform system 1001 in accordance with the current subject matter. This example is being provided for illustrating purposes only and does not limit the current subject matter. The system 1001 includes a live feed from an event 1080 (e.g., a sporting event such as a tennis match), a wagering platform server 1010, and a plurality of participant devices 1051-1053. The live feed of the event 1080 can include, for example, video, sound, and/or other data, which are transmitted to the wagering platform server 1010 via, for example, a one-way or two-way communication connection. The wagering platform server 1010 can include one or more processors 1011, memories 1012, modules 1013, and databases 1014 for implementing the wagering platform and perform one or more features discussed herein. The wagering platform server 1010 is also in communication 1091 with the plurality of participant devices 1051-1053 to transmit and receive, for example, video, sound, and/or other data to and from the participant devices. Each of the participant devices can also include one or more processors, memories, modules, and/or databases to implement, for example, portions of the wagering platform and perform one of more features discussed herein.

Figure 12:
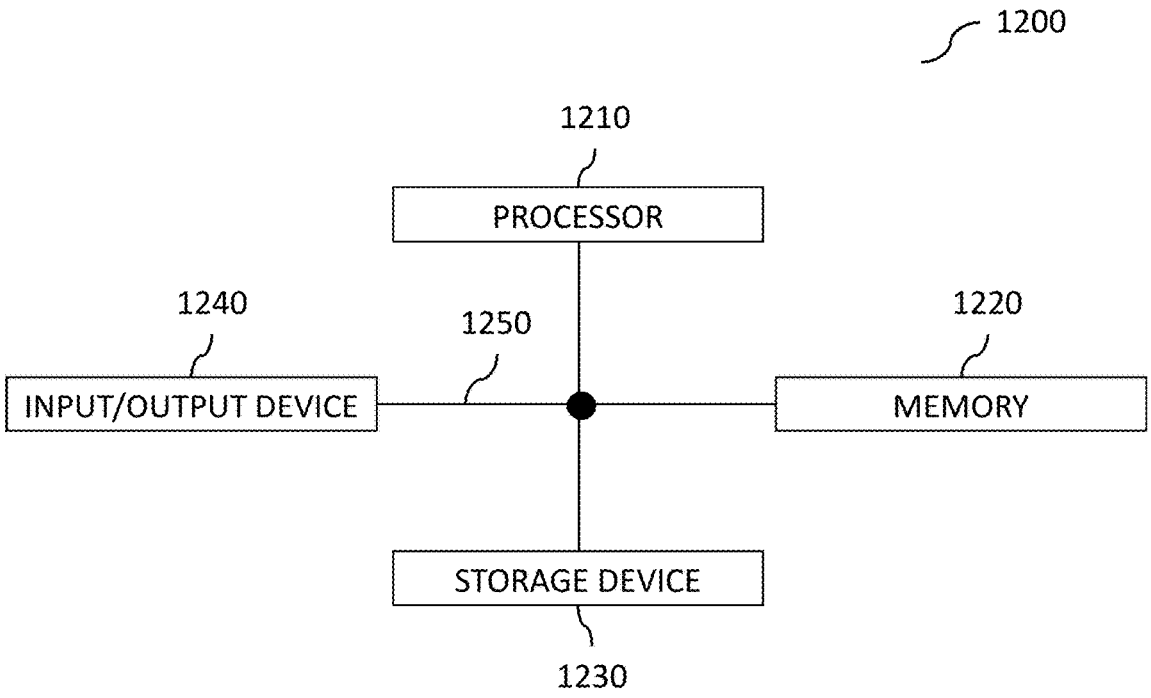
FIG. 12 illustrates an exemplary system, according to some implementations of the current subject matter.

In some implementations, the current subject matter can be configured to be implemented in a system 1200, as shown in FIG. 12. The system 1200 can include a processor 1210, a memory 1220, a storage device 1230, and an input/output device 1240. Each of the components 1210, 1220, 1230 and 1240 can be interconnected using a system bus 1250. The processor 1210 can be configured to process instructions for execution within the system 1200. In some implementations, the processor 1210 can be a single-threaded processor. In alternate implementations, the processor 1210 can be a multi-threaded processor. The processor 1210 can be further configured to process instructions stored in the memory 1220 or on the storage device 1230, including receiving or sending information through the input/output device 1240. The memory 1220 can store information within the system 1200. In some implementations, the memory 1220 can be a computer-readable medium. In alternate implementations, the memory 1220 can be a volatile memory unit. In yet some implementations, the memory 1220 can be a non-volatile memory unit. The storage device 1230 can be capable of providing mass storage for the system 1200. In some implementations, the storage device 1230 can be a computer-readable medium. In alternate implementations, the storage device 1230 can be a floppy disk device, a hard disk device, an optical disk device, a tape device, non-volatile solid state memory, or any other type of storage device. The input/output device 1240 can be configured to provide input/output operations for the system 1200. In some implementations, the input/output device 1240 can include a keyboard and/or pointing device. In alternate implementations, the input/output device 1240 can include a display unit for displaying graphical user interfaces.

Figure 13:
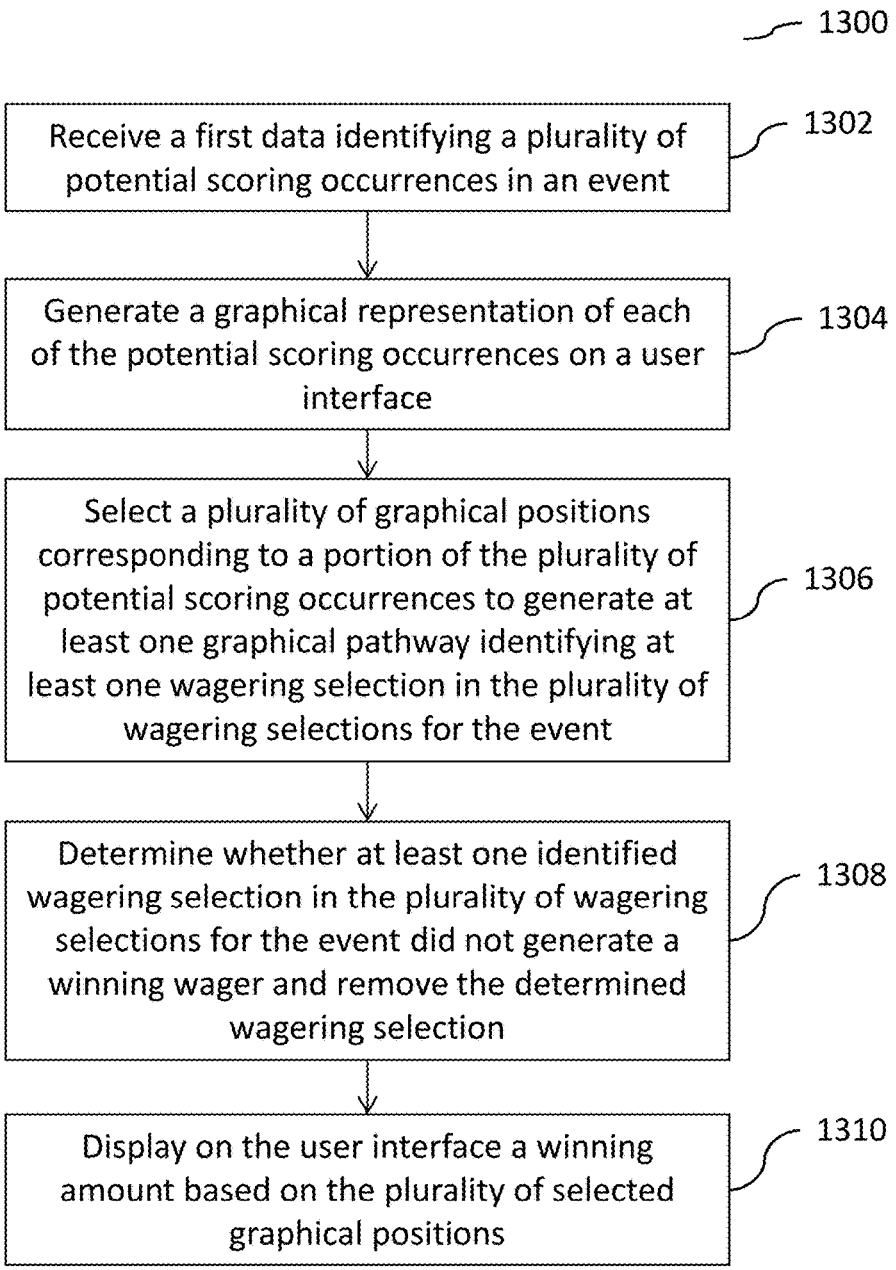
FIG. 13 illustrates an exemplary method, according to some implementations of the current subject matter.

FIG. 13 illustrates an exemplary method 1300 for generating graphical representation of wagering selections, according to some implementations of the current subject matter. The method 1300 can be performed using one or more computer processors that can be communicatively coupled using a network (e.g., a wireless network, a wired network, and/or any combination thereof). The processes performed can be executed using one or more software and/or hardware components, and/or any combination thereof. Further the method 1300 can be executed using one or more of the following: a telephone, a wireless telephone, a smartphone, a tablet computer, a phablet, a laptop, a personal computer, a personal digital assistant, and/or any other computing device, and/or any combination thereof.

At 1302, a first data identifying a plurality of potential scoring occurrences in an event can be received. The first data can include an identification of an event (e.g., tennis match, participants, stages of the events, possible scores at each stage of the match (which can be generated based on the type of the event and available scores, etc.) and/or any other data). The first data can also be received in response to a query that can be executed using the user's device. The query can be directed via an external network to a server that can be communicatively coupled to a database. The server can be associated with a third party that can be tracking progression of the event.

At 1304, based on the received first data, a graphical representation of each of the potential scoring occurrences can be generated on a user interface (as for example, shown in FIG. 2). The generation of graphical representations can include arranging, using an identifier (e.g., graphical coordinates, and/or any other data) corresponding to each potential scoring occurrence, a graphical position of each potential scoring occurrence in the plurality of scoring occurrences on the user interface to display a graphical maze.

At 1306, a plurality of graphical positions corresponding to a portion of the plurality of potential scoring occurrences can be selected to generate at least one graphical pathway (as for example is shown in FIGS. 3-5) identifying at least one wagering selection in the plurality of wagering selections for the event. The plurality of wagering selections can correspond to the plurality of selected graphical positions. Each graphical pathway can correspond to a particular winning wager amount or "payout" in the event of a win (e.g., as shown in FIG. 5).

At 1308, a determination can be made during a progression of the event in real-time whether at least one identified wagering selection in the plurality of wagering selections for the event did not generate a winning wager (as for example is shown in FIGS. 7-9). The determined wagering selection that did not win can be removed from the user interface. At 1310, a winning amount based on the plurality of selected graphical positions can be displayed on the user interface at the conclusion of the event (as for example is shown in FIG. 10).

In some implementations, the current subject matter can include one or more of the following optional features. In some implementations, the method can also include determining, during the progression of the event, whether at least one identified wagering selection in the plurality of wagering selections for the event generated a winning wager, and displaying, at the conclusion of the event, a winning amount corresponding to the winning wager on the user interface.

In some implementations, the method can include removing, during the progression of the event, from the user interface at least one identified wagering selection in the plurality of wagering selections that will not be generating a winning wager. The removed wagering selection can correspond to at least one selected graphical position associated with a potential scoring occurrence that did not match an actual scoring occurrence during progression of the event.

In some implementations, the method can include displaying, on the user interface, a counter having a counter value corresponding to a number of identified wagering selections. The counter value can be decreased based on a determination that at least one wagering selection is removed from the user interface.

The systems and methods disclosed herein can be embodied in various forms including, for example, a data processor, such as a computer that also includes a database, digital electronic circuitry, firmware, software, or in combinations of them. Moreover, the above-noted features and other aspects and principles of the present disclosed implementations can be implemented in various environments. Such environments and related applications can be specially constructed for performing the various processes and operations according to the disclosed implementations or they can include a general-purpose computer or computing platform selectively activated or reconfigured by code to provide the necessary functionality. The processes disclosed herein are not inherently related to any particular computer, network, architecture, environment, or other apparatus, and can be implemented by a suitable combination of hardware, software, and/or firmware. For example, various general-purpose machines can be used with programs written in accordance with teachings of the disclosed implementations, or it can be more convenient to construct a specialized apparatus or system to perform the required methods and techniques.

The systems and methods disclosed herein can be implemented as a computer program product, i.e., a computer program tangibly embodied in an information carrier, e.g., in a machine readable storage device or in a propagated signal, for execution by, or to control the operation of, data processing apparatus, e.g., a programmable processor, a computer, or multiple computers. A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a communication network.

As used herein, the term "user" can refer to any entity including a person or a computer.

Although ordinal numbers such as first, second, and the like can, in some situations, relate to an order; as used in this document ordinal numbers do not necessarily imply an order. For example, ordinal numbers can be merely used to distinguish one item from another. For example, to distinguish a first event from a second event, but need not imply any chronological ordering or a fixed reference system (such that a first event in one paragraph of the description can be different from a first event in another paragraph of the description).

The foregoing description is intended to illustrate but not to limit the scope of the invention, which is defined by the scope of the appended claims. Other implementations are within the scope of the following claims.

These computer programs, which can also be referred to as programs, software, software applications, applications, components, or code, include machine instructions for a programmable processor, and can be implemented in a high-level procedural and/or object-oriented programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid state memory or a magnetic hard drive or any equivalent storage medium. The machine-readable medium can alternatively or additionally store such machine instructions in a transient manner, such as for example as would a processor cache or other random access memory associated with one or more physical processor cores.

To provide for interaction with a user, the subject matter described herein can be implemented on a computer having a display device, such as for example a cathode ray tube (CRT) or a liquid crystal display (LCD) monitor for displaying information to the user and a keyboard and a pointing device, such as for example a mouse or a trackball, by which the user can provide input to the computer. Other kinds of devices can be used to provide for interaction with a user as well. For example, feedback provided to the user can be any form of sensory feedback, such as for example visual feedback, auditory feedback, or tactile feedback; and input from the user can be received in any form, including, but not limited to, acoustic, speech, or tactile input.

The subject matter described herein can be implemented in a computing system that includes a back-end component, such as for example one or more data servers, or that includes a middleware component, such as for example one or more application servers, or that includes a front-end component, such as for example one or more client computers having a graphical user interface or a Web browser through which a user can interact with an implementation of the subject matter described herein, or any combination of such back-end, middleware, or front-end components. The components of the system can be interconnected by any form or medium of digital data communication, such as for example a communication network. Examples of communication networks include, but are not limited to, a local area network ("LAN"), a wide area network ("WAN"), and the Internet.

The computing system can include clients and servers. A client and server are generally, but not exclusively, remote from each other and typically interact through a communication network. The relationship of client and server arises by virtue of computer programs running on the respective computers and having a client-server relationship to each other.

The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and sub-combinations of the disclosed features and/or combinations and sub-combinations of several further features disclosed above. In addition, the logic flows depicted in the accompanying figures and/or described herein do not necessarily require the particular order shown, or sequential order, to achieve desirable results. Other implementations can be within the scope of the following claims.

What is claimed:

1. A computer-implemented method, comprising:

receiving a first data identifying a plurality of potential scoring occurrences in an event;

generating, based on the received first data, a graphical representation of each of the plurality of potential scoring occurrences on a user interface, the generating including arranging, using an identifier corresponding to each potential scoring occurrence, a graphical position of each potential scoring occurrence in the plurality of potential scoring occurrences on the user interface to display a graphical maze;

selecting a plurality of graphical positions corresponding to a portion of the plurality of potential scoring occurrences to generate at least one graphical pathway identifying at least one wagering selection in a plurality of wagering selections for the event, the plurality of wagering selections corresponding to the plurality of selected graphical positions;

determining, during a progression of the event in real-time, whether at least one identified wagering selection in the plurality of wagering selections for the event did not generate a winning wager and removing from the user interface the determined at least one identified wagering selection; and displaying, at a conclusion of the event, on the user interface a winning amount based on the plurality of selected graphical positions;

wherein the receiving, the generating, the selecting, the determining, and the displaying are performed using at least one processor of at least one computing system.

2. The method according to claim 1, further comprising determining, during the progression of the event, whether the at least one identified wagering selection in the plurality of wagering selections for the event generated the winning wager; and displaying, at the conclusion of the event, another winning amount corresponding to the winning wager on the user interface.

3. The method according to claim 1, further comprising removing, during the progression of the event, from the user interface the at least one identified wagering selection in the plurality of wagering selections that will not be generating the winning wager.

4. The method according to claim 3, wherein the at least one removed wagering selection corresponds to at least one of the plurality of selected graphical positions associated with a potential scoring occurrence that did not match an actual scoring occurrence during the progression of the event.

5. The method according to claim 1, further comprising graphically presenting, on the user interface, a counter having a counter value corresponding to a number of identified wagering selections.

6. The method according to claim 5, further comprising decreasing the counter value based on a determination that at least one identified wagering selection is removed from the user interface.

7. A system comprising:

at least one programmable processor; and a machine-readable medium storing instructions that, when executed by the at least one programmable processor, cause the at least one programmable processor to perform operations comprising:

receiving a first data identifying a plurality of potential scoring occurrences in an event;

generating, based on the received first data, a graphical representation of each of the plurality of potential scoring occurrences on a user interface, the generating including arranging, using an identifier corresponding to each potential scoring occurrence, a graphical position of each potential scoring occurrence in the plurality of potential scoring occurrences on the user interface to display a graphical maze;

selecting a plurality of graphical positions corresponding to a portion of the plurality of potential scoring occurrences to generate at least one graphical pathway identifying at least one wagering selection in a plurality of wagering selections for the event, the plurality of wagering selections corresponding to the plurality of selected graphical positions;

determining, during a progression of the event in real-time, whether at least one identified wagering selection in the plurality of wagering selections for the event did not generate a winning wager and removing from the user interface the determined at least one identified wagering selection; and displaying, at a conclusion of the event, on the user interface a winning amount based on the plurality of selected graphical positions.

8. The system according to claim 7, wherein the operations further comprise determining, during the progression of the event, whether the at least one identified wagering selection in the plurality of wagering selections for the event generated the winning wager; and displaying, at the conclusion of the event, another winning amount corresponding to the winning wager on the user interface.

9. The system according to claim 7, wherein the operations further comprise removing, during the progression of the event, from the user interface the at least one identified wagering selection in the plurality of wagering selections that will not be generating the winning wager.

10. The system according to claim 9, wherein the at least one removed wagering selection corresponds to at least one of the plurality of selected graphical positions associated with a potential scoring occurrence that did not match an actual scoring occurrence during the progression of the event.

11. The system according to claim 7, wherein the operations further comprise graphically presenting, on the user interface, a counter having a counter value corresponding to a number of identified wagering selections.

12. The system according to claim 11, wherein the operations further comprise decreasing the counter value based on a determination that at least one identified wagering selection is removed from the user interface.

13. A computer program product comprising a non-transitory machine-readable medium storing instructions that, when executed by at least one programmable processor, cause the at least one programmable processor to perform operations comprising:

receiving a first data identifying a plurality of potential scoring occurrences in an event;

generating, based on the received first data, a graphical representation of each of the plurality of potential scoring occurrences on a user interface, the generating including arranging, using an identifier corresponding to each potential scoring occurrence, a graphical position of each potential scoring occurrence in the plurality of potential scoring occurrences on the user interface to display a graphical maze;

selecting a plurality of graphical positions corresponding to a portion of the plurality of potential scoring occurrences to generate at least one graphical pathway identifying at least one wagering selection in a plurality of wagering selections for the event, the plurality of wagering selections corresponding to the plurality of selected graphical positions;

determining, during a progression of the event in real-time, whether at least one identified wagering selection in the plurality of wagering selections for the event did not generate a winning wager and removing from the user interface the determined at least one identified wagering selection; and displaying, at a conclusion of the event, on the user interface a winning amount based on the plurality of selected graphical positions.

14. The computer program product according to claim 13, wherein the operations further comprise determining, during the progression of the event, whether the at least one identified wagering selection in the plurality of wagering selections for the event generated the winning wager; and displaying, at the conclusion of the event, another winning amount corresponding to the winning wager on the user interface.

15. The computer program product according to claim 13, wherein the operations further comprise removing, during the progression of the event, from the user interface the at least one identified wagering selection in the plurality of wagering selections that will not be generating the winning wager.

16. The computer program product according to claim 15, wherein the at least one removed wagering selection corresponds to at least one of the plurality of selected graphical positions associated with a potential scoring occurrence that did not match an actual scoring occurrence during the progression of the event.

17. The computer program product according to claim 13, wherein the operations further comprise graphically presenting, on the user interface, a counter having a counter value corresponding to a number of identified wagering selections.

18. The computer program product according to claim 17, wherein the operations further comprise decreasing the counter value based on a determination that at least one identified wagering selection is removed from the user interface.

* * * * *